US012616284B2

(12) United States Patent
Luo

(10) Patent No.: US 12,616,284 B2
(45) Date of Patent: May 5, 2026

(54) UMBRELLA

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 255 days.

(21) Appl. No.: 18/636,884

(22) Filed: Apr. 16, 2024

(65) Prior Publication Data

US 2025/0228342 A1 Jul. 17, 2025

(30) Foreign Application Priority Data

Jan. 11, 2024 (CN) ..... 202410045010.0

(51) Int. Cl.

*A45B 25/06* (2006.01)
*A45B 23/00* (2006.01)
*A45B 25/14* (2006.01)

(52) U.S. Cl.

CPC ..... *A45B 25/06* (2013.01); *A45B 23/00* (2013.01); *A45B 2023/0012* (2013.01); *A45B 25/14* (2013.01)

(58) Field of Classification Search

CPC ..... A45B 2025/146; A45B 25/14
USPC ..... 135/44, 15.1, 28, 38, 39
See application file for complete search history.

(56) References Cited

U.S. PATENT DOCUMENTS 289,230 A * 11/1883 Colby ..... A45B 21/00 135/33.4
401,536 A * 4/1889 Box ..... A45B 25/02 135/75
476,364 A * 6/1892 Collins ..... A45B 25/06 135/30
479,310 A * 7/1892 Seymour ..... A45B 19/06 135/26
483,212 A * 9/1892 Fleuss ..... A45B 25/06 135/31
2,047,711 A * 7/1936 Siers ..... A45B 19/06 248/408
2,661,752 A * 12/1953 Kampf ..... A45B 25/14 188/67
3,439,690 A * 4/1969 Weber ..... A45B 19/10 135/26
3,831,614 A * 8/1974 Weber ..... A45B 19/00 135/26
4,424,824 A * 1/1984 Becher ..... A45B 19/04 135/20.3
2003/0015229 A1* 1/2003 Ma ..... A45B 25/14 135/22

* cited by examiner

*Primary Examiner* — Noah Chandler Hawk
(74) *Attorney, Agent, or Firm* — Wang Law Firm, Inc.

(57) ABSTRACT

An umbrella includes a column having a middle portion; an upper nest; a lower nest; a plurality of long rods; a plurality of short rods each; a crank handle assembly disposed on the middle portion of the column. The lower nest has a plurality of first long rod grooves on a periphery of the lower nest; the crank handle assembly includes a housing and a crank handle, correspondingly, the housing has a plurality of second long rod grooves. The umbrella of the present invention is simple and reasonable in structure, greatly reduced in size and convenience to store and carry, and reduces the cost for packaging and transportation.

9 Claims, 7 Drawing Sheets

UMBRELLA

TECHNICAL FIELD OF THE INVENTION

The present invention relates to a field of umbrellas, and in particular to an umbrella in smaller package.

BACKGROUND OF THE INVENTION

As a kind of outdoor leisure items, umbrellas are widely applied in squares, beaches, parks, gardens or similar places to shield an individual from sun. Most of the existing umbrellas comprise a column, a plurality of rods, nests and an umbrella canopy, wherein a crank handle assembly is arranged on the column, and the umbrella canopy is supported by a number of rods when in use, so as to achieve a shading effect.

Since the crank handle assembly is arranged on the column, the rods will be resisted by a lower nest and the crank handle assembly, so that the size is large, and a cost for packaging and transportation is increased sharply.

At present, many three-fold umbrellas and four-fold umbrellas are sold in the market. Those kinds of umbrellas are reduced in size by folding rods so that they are convenient to carry. However, such folding umbrellas are small umbrellas and cannot be used as large outdoor umbrellas.

SUMMARY OF THE INVENTION

It is an object of the present invention to provide an umbrella in smaller package, which is simple and reasonable in structure, greatly reduced in size and reduces the packaging cost.

For achieving the above object, the umbrella comprises a column having a middle portion; an upper nest; a lower nest; a plurality of long rods each having a middle portion; a plurality of short rods each having a first end and a second end; a crank handle assembly disposed on the middle portion of the column; wherein, the lower nest has a plurality of first long rod grooves on a periphery of the lower nest for receiving the plurality of long rods when the umbrella is folded; the crank handle assembly comprises a housing and a crank handle, correspondingly, the housing has a plurality of second long rod grooves vertically distributed on an outer surface of the housing for receiving the plurality of long rods when the umbrella is folded.

Preferably, the lower nest has a plurality of short rod grooves distributed at regular intervals on the periphery of the lower nest; the first end of each short rod is located inside one corresponding short rod groove and is rotatably connected to the lower nest, the second end of each short rod is hinged to the middle portion of one corresponding long rod; and each first long rod groove is disposed between two adjacent short rod grooves.

Preferably, each first long rod groove has an opening end and an inner end, a width of the opening end of each first long rod groove is greater than a width of the inner end of each first long rod groove.

Preferably, the cross section of each first long rod groove is U-shaped or V-shaped. Of course, the cross section of each first long rod groove may also have other shape.

Preferably, the housing is sleeved outside the column, and the crank handle in L-shaped is disposed on the outer surface of the housing.

Preferably, a cross-sectional shape of each second long rod groove is adapted to that of each long rod, a position of each second long rod groove corresponding to each first long rod groove of the lower nest, and the number of the second long rod grooves is the same as the number of the long rods.

Preferably, each second long rod groove is arch-shaped with a width for receiving two long rods, and the number of the second grooves is half of the number of the long rods.

Preferably, the housing has a plurality of arc-shaped stripes vertically arranged at regular intervals on the outer surface of the housing, and arc-shaped grooves are defined between two adjacent two arc-shaped stripes; the housing has a plurality of partition bars each vertically distributed inside one arc-shaped groove to divide the corresponding arc-shaped groove into two second grooves, so that one arc-shaped groove is capable of receiving two long rods, and the number of the arc-shaped grooves is half of the number of the long rods.

Preferably, both long rod and short rod are hollow square or rectangular tubes; each long rod has a connecting hole on the middle portion of the long rod, the second end of each short rod is hinged to the middle portion of a corresponding long rod through a connecting piece mounted in the connecting hole.

Compared with the prior art, the present invention has the following advantages. Since the lower nest and the housing of the crank handle assembly has first long rod grooves and second long rod grooves, respectively, when the umbrella is folded, each long rod is located inside the corresponding groove. Therefore, the packaging size is greatly reduced. Moreover, the crank handle is in L-shaped to prevent from being resisted against the long rods, so that the packaging size is reduced. The umbrella of the present invention is simple and reasonable in structure, greatly reduced in size and convenience to store and carry, and reduces the cost for packaging and transportation.

DETAILED DESCRIPTION OF THE INVENTION

Figure 1:
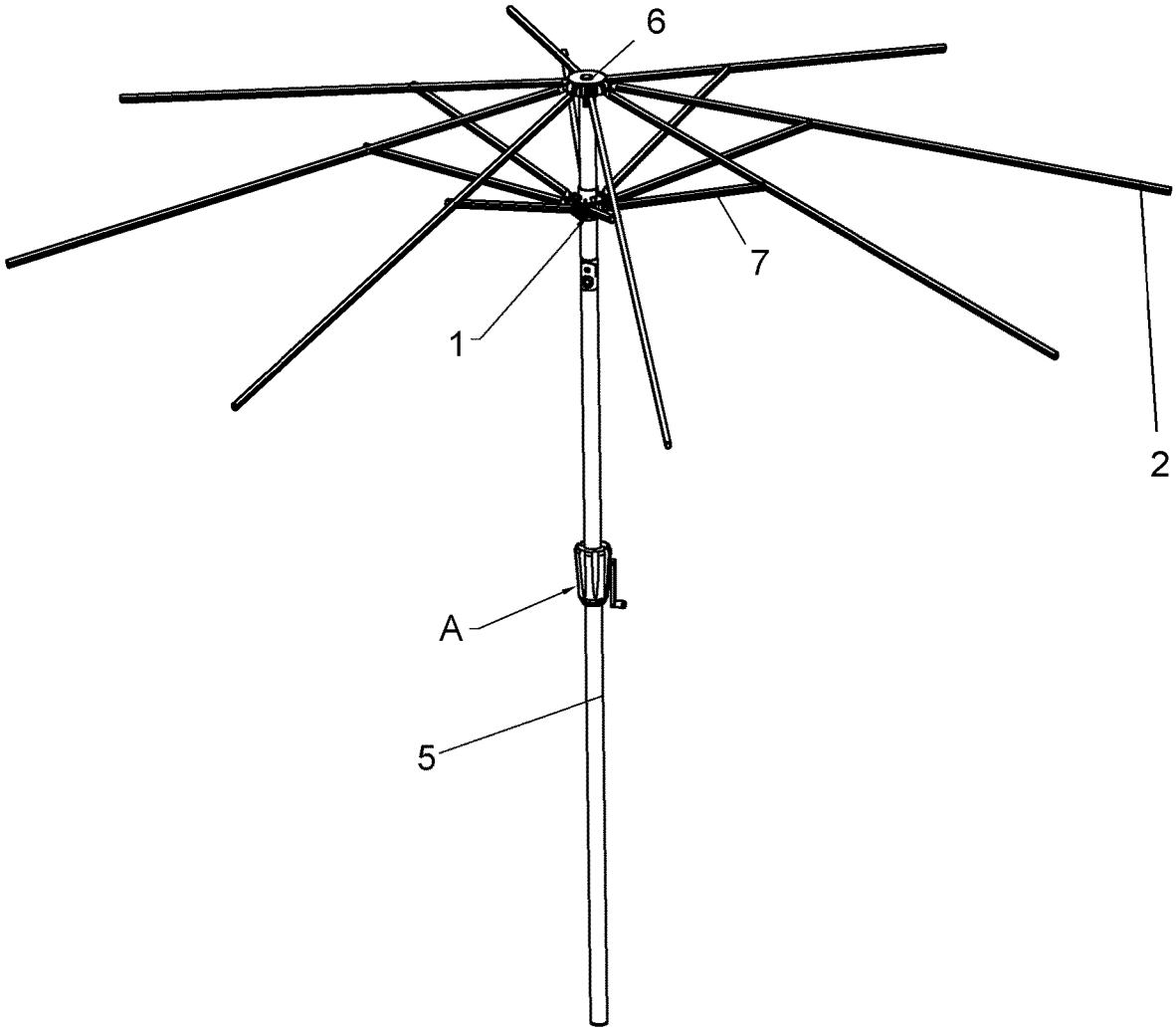
FIG. 1 is a perspective view of an umbrella according to Embodiment 1 of the present invention.
Figure 2:
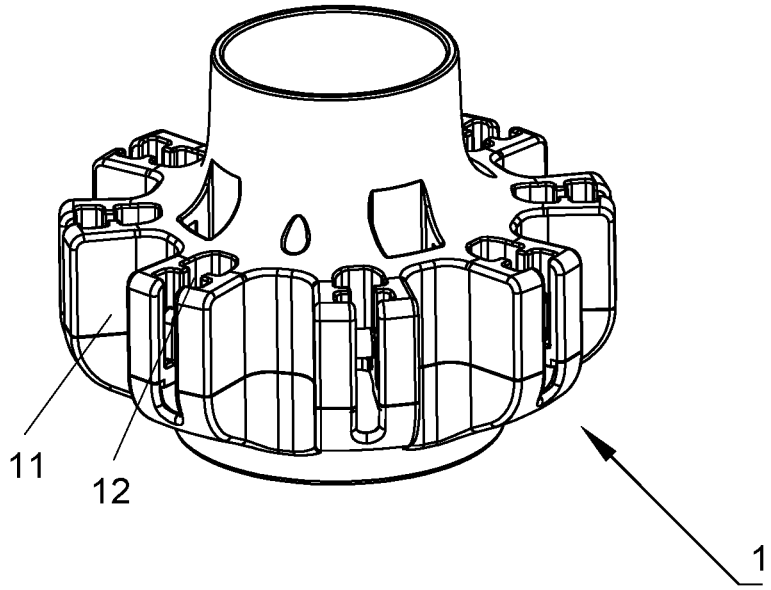
FIG. 2 is a perspective view of a lower nest according to Embodiment 1 of the present invention.
Figure 3:
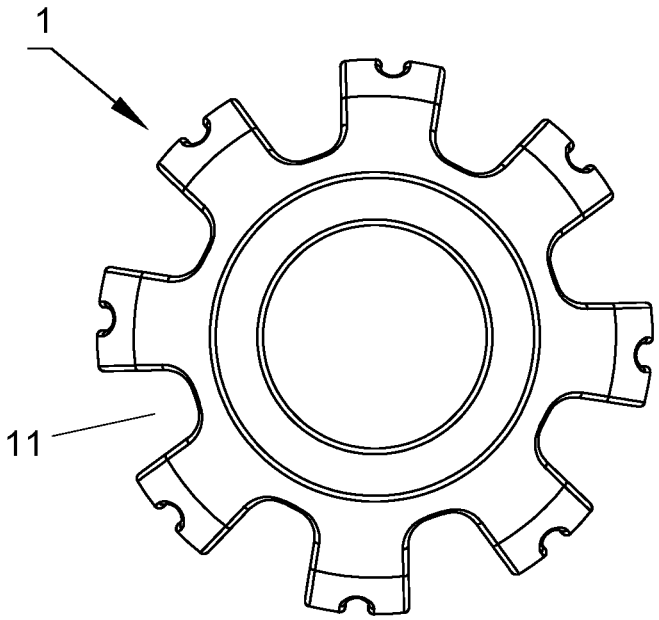
FIG. 3 is a bottom view of the lower nest according to Embodiment 1 of the present invention.
Figure 4:
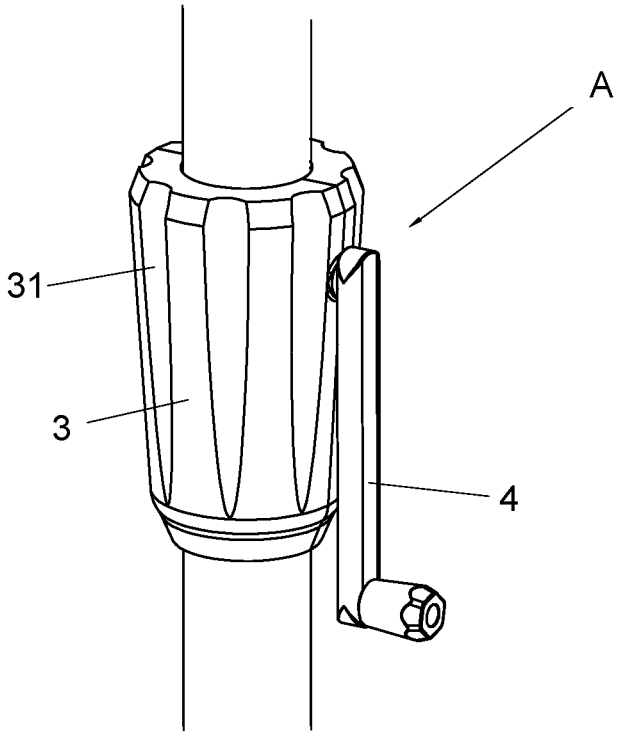
FIG. 4 is a perspective view of a crank handle assembly according to Embodiment 1 of the present invention.
Figure 5:
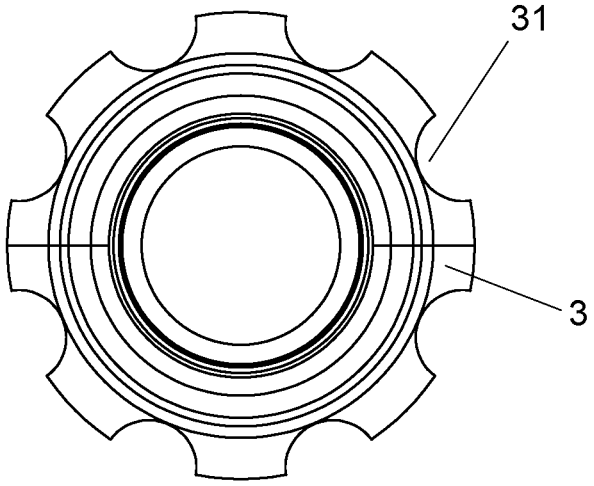
FIG. 5 is a bottom view of a housing of the crank handle assembly in FIG. 4.
Figure 6:
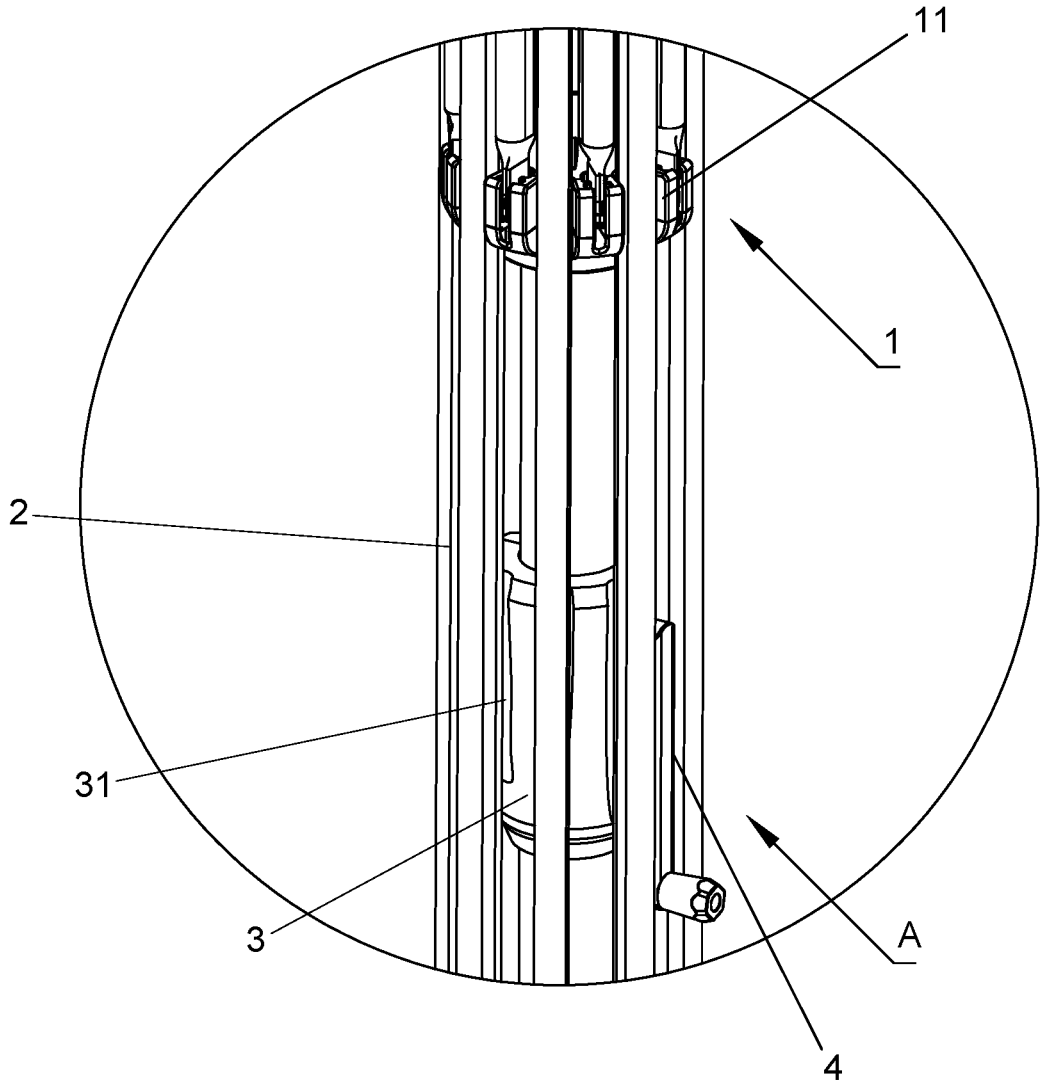
FIG. 6 is a perspective view of a plurality of the long rods located inside the lower nest and the housing when the umbrella is folded according to Embodiment 1 of the present invention.
Figure 7:
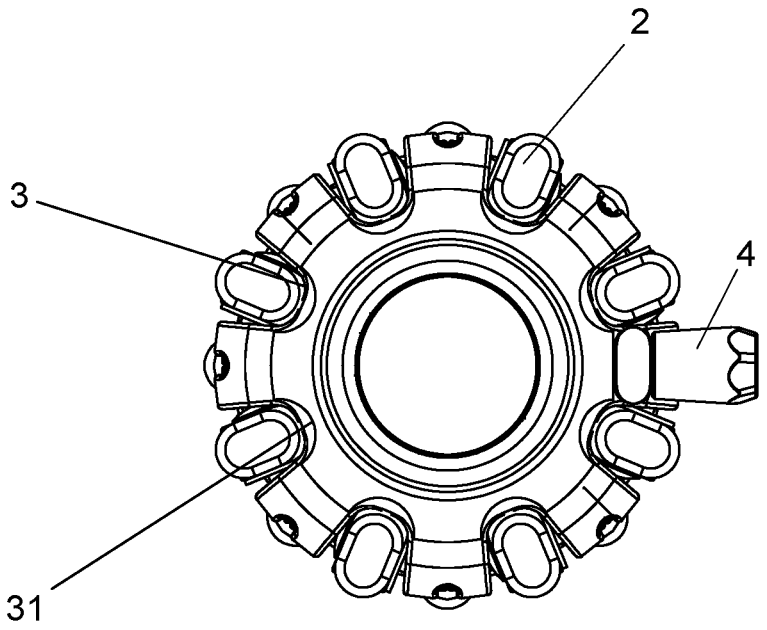
FIG. 7 is a bottom view of the FIG. 6.

The present invention will be further described below in detail by embodiments with reference to the accompanying drawings.

Embodiment 1

FIGS. 1-7 show a first preferred embodiment of an umbrella of the present invention. The umbrella comprises a column 5 having a middle portion; an upper nest 6; a lower nest 1; a plurality of long rods 2 each having a middle portion; a plurality of short rods 7 each having a first end and a second end; a crank handle assembly A disposed on the middle portion of the column 5; wherein, the lower nest 1 has a plurality of first long rod grooves 11 on a periphery of the lower nest 1 for receiving the plurality of long rods 2 when the umbrella is folded; the crank handle assembly A comprises a housing 3 and a crank handle 4, correspondingly, the housing 3 has a plurality of second long rod grooves 31 vertically distributed on an outer surface of the housing 3 for receiving the plurality of long rods 2 when the umbrella is folded.

Specifically, the lower nest 1 has a plurality of short rod grooves 12 distributed at regular intervals on the periphery of the lower nest 1; both long rod 2 and the short rod 7 are hollow square or rectangular tubes; each long rod 2 has a connecting hole on the middle portion of the long rod 2, the second end of each short rod 7 is hinged to the middle portion of a corresponding long rod 2 through a connecting piece mounted in the connecting hole, providing a room for mounting the plurality of the rods. In this embodiment, the number of the long rods 2 and the first long rod grooves 11 are both eight. Each first long rod groove 11 is disposed between two adjacent short rod grooves 12. The cross section of each first long rod groove 11 is U-shaped or V-shaped, and each first long rod groove 11 has an opening end and an inner end, a width of the opening end of each first long rod groove 11 is greater than a width of the inner end of each first long rod groove 11. Of course, the cross section of each first long rod groove 11 may also have other reasonable shape as long as the cross section can be adapted to each long rod 2. The number of the first long rod groove 11 is the same as that of the long rod 2. The housing 3 is cylindrical-shaped with a large-diameter upper end and a small-diameter lower end, the housing 3 is fixed on the column 5, and the number of the second long rod groove 31 corresponding to the first long rod groove 11 of the lower nest 1 is eight. Generally, the position of the first long rod groove 11 is almost in a line with the position of the corresponding second long rod groove 31. The cross section of an upper end of the second long rod groove 31 is in arc-shaped, the depth of the upper end of the second long rod grooves 31 is larger than that of the lower end of the second long rod grooves 31, and the width of the upper end of the second long rod grooves 31 is larger than that of the lower end of the second long rod grooves 31. The crank handle 4 is disposed on the outer surface of the housing 3, and the crank handle 4 is in L-shaped to prevent from being resisted against the long rods 2 when the umbrella is folded. Of course, the cross section of the upper end of each second long rod groove 11 may also have other reasonable shape as long as the cross section can be adapted to each long rod 2.

Thus, when the umbrella is folded, each long rod 2 is exactly located inside the corresponding first long rod groove 11 on the lower nest 1 and the corresponding second long rod groove 31 on the housing 3, so that the packaging size of the umbrella is greatly reduced.

Embodiment 2

Figure 8:
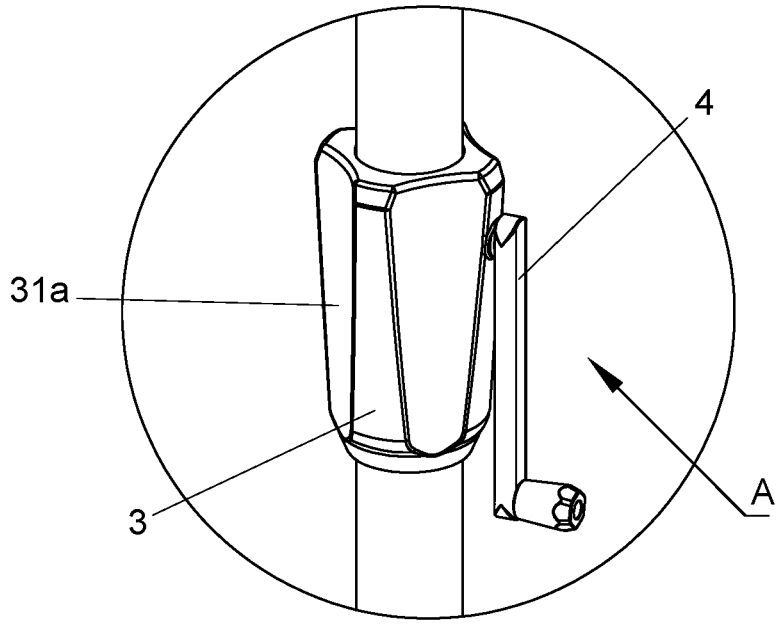
FIG. 8 is a perspective view of a crank handle assembly according to Embodiment 2 of the present invention.
Figure 9:
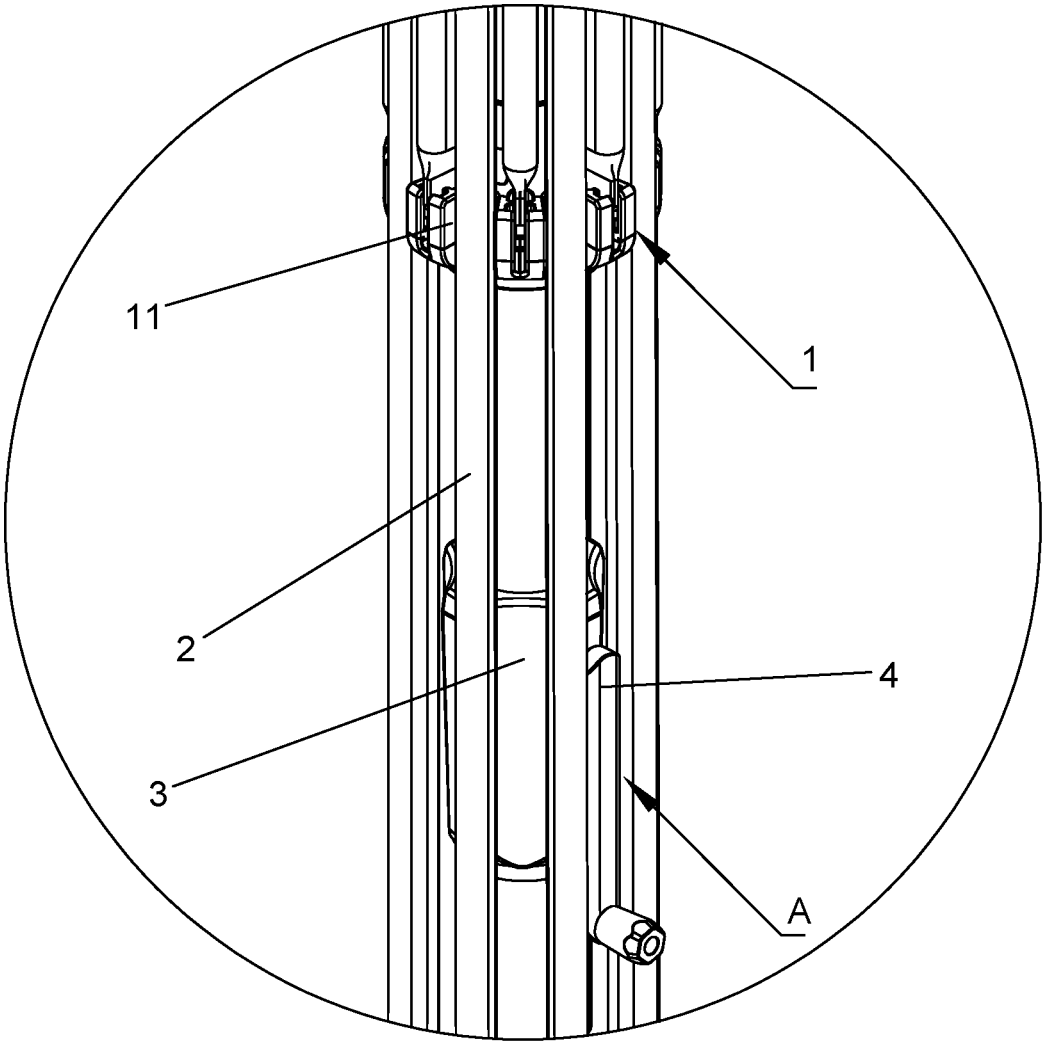
FIG. 9 is a perspective view of a plurality of the long rods located inside the lower nest and the housing when the umbrella is folded according to Embodiment 2 of the present invention.

FIGS. 8 and 9 show a second preferred embodiment of an umbrella of the present invention. The umbrella in this embodiment differs from that in Embodiment 1 in the housing 3 of the crank handle assembly A. In this embodiment, the two second long rod grooves 31 on the housing 3 in Embodiment 1 are combined into one second long rod groove 31*a* in Embodiment 2. Each second long rod groove 31 is arch-shaped with a width for receiving two long rods 2, and the number of the second grooves 31 is four, which is half of the number of the long rods 2.

When the umbrella is folded, two long rods 2 are located inside one second long rod groove 31*a*, so that the packaging size of the umbrella is greatly reduced.

Embodiment 3

Figure 10:
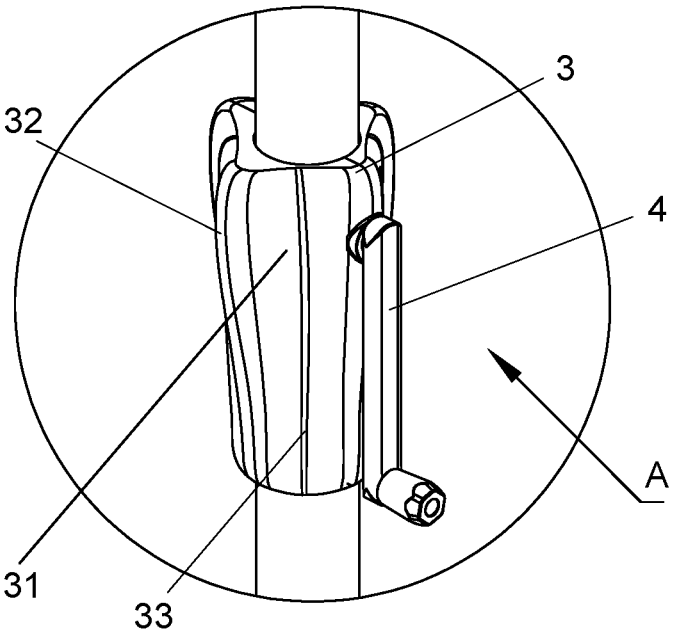
FIG. 10 is a perspective view of a crank handle assembly according to Embodiment 3 of the present invention.
Figure 11:
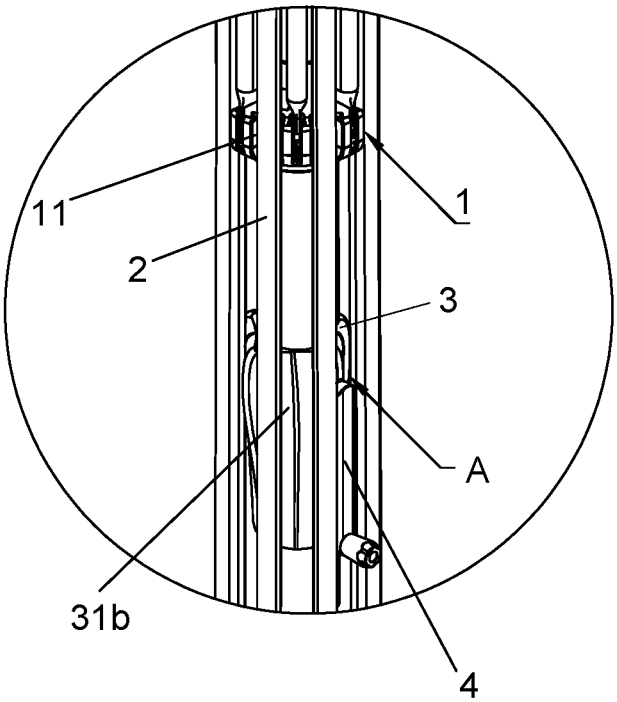
FIG. 11 is a perspective view of a plurality of the long rods located inside the lower nest and the housing when the umbrella is folded according to Embodiment 3 of the present invention.

FIGS. 10 and 11 show a third preferred embodiment of an umbrella of the present invention. The umbrella in this embodiment differs from that in Embodiment 1 in the housing 3 of the crank handle assembly A. In this embodiment, the housing 3 has a plurality of arc-shaped stripes 32 vertically arranged at regular intervals on the outer surface of the housing 3, and arc-shaped grooves 31*b* are defined between two adjacent two arc-shaped stripes 32; the housing 3 has a plurality of partition bars 33 each vertically distributed inside one arc-shaped groove 31*b* to divide the corresponding arc-shaped groove 31*b* into two second grooves, so that one arc-shaped groove 31*b* is capable of receiving two long rods 2.

When the umbrella is folded, two long rods 2 are located inside corresponding arc-shaped groove 31*b*, so that the packaging size of the umbrella is greatly reduced.

The protection scope of the present invention is not limited to each embodiment described in this description. Any changes and replacements made on the basis of the scope of the present invention patent and of the description shall be included in the scope of the present invention patent.

The invention claimed is:

1. An umbrella, comprising:

a column having a middle portion;

an upper nest;

a lower nest;

a plurality of long rods each having a middle portion;

a plurality of short rods each having a first end and a second end;

a crank handle assembly disposed on the middle portion of the column;

wherein, the lower nest has a plurality of first long rod grooves on a periphery of the lower nest for receiving the plurality of long rods when the umbrella is folded;

the crank handle assembly comprises a housing and a crank handle, correspondingly, the housing has a plurality of second long rod grooves vertically distributed on an outer surface of the housing for receiving the plurality of long rods when the umbrella is folded.

2. The umbrella of claim 1, wherein the lower nest has a plurality of short rod grooves distributed at regular intervals on the periphery of the lower nest;

the first end of each short rod is located inside one corresponding short rod groove and is rotatably connected to the lower nest, the second end of each short rod is hinged to the middle portion of one corresponding long rod;

and each first long rod groove is disposed between two adjacent short rod grooves.

3. The umbrella of claim 1, wherein each first long rod groove has an opening end and an inner end, a width of the opening end of each first long rod groove is greater than a width of the inner end of each first long rod groove.

4. The umbrella of claim 3, wherein the cross section of each first long rod groove is U-shaped or V-shaped.

5. The umbrella of claim 1, wherein the housing is sleeved outside the column, and the crank handle is disposed on the outer surface of the housing.

6. The umbrella of claim 5, wherein a cross-sectional shape of each second long rod groove is adapted to that of each long rod, a position of each second long rod groove corresponding to each first long rod groove of the lower nest, and the number of the second long rod grooves is the same as the number of the long rods.

7. The umbrella of claim 5, wherein each second long rod groove is arch-shaped with a width for receiving two long rods, and the number of the second grooves is half of the number of the long rods.

8. The umbrella of claim 5, wherein the housing has a plurality of arc-shaped stripes vertically arranged at regular intervals on the outer surface of the housing, and arc-shaped grooves are defined between two adjacent two arc-shaped stripes;

the housing has a plurality of partition bars each vertically distributed inside one arc-shaped groove to divide the corresponding arc-shaped groove into two second grooves, so that one arc-shaped groove is capable of receiving two long rods, and the number of the arc-shaped grooves is half of the number of the long rods.

9. The umbrella of claim 1, wherein each long rod has a connecting hole on the middle portion of the long rod, the second end of each short rod is hinged to the middle portion of a corresponding long rod through a connecting piece mounted in the connecting hole.

* * * * *